US006437701B1

(12) United States Patent
Muller

(10) Patent No.: US 6,437,701 B1
(45) Date of Patent: Aug. 20, 2002

(54) APPARATUS AND METHOD FOR A MACHINE STABILITY SYSTEM FOR AN ARTICULATED WORK MACHINE

(75) Inventor: Thomas P. Muller, Montgomery, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/740,283

(22) Filed: Dec. 18, 2000

(51) Int. Cl.[7] ..... G08B 21/00

(52) U.S. Cl. ..... 340/679; 340/684; 340/686.1; 340/389; 340/440; 701/124

(58) Field of Search ..... 340/679, 684, 340/686.1, 689, 440, 685; 701/124

(56) References Cited

U.S. PATENT DOCUMENTS

| | | | | |
|---|---|---|---|---|
| 3,759,541 A | | 9/1973 | Peterson | |
| 4,192,523 A | | 3/1980 | Hausmann | |
| 4,284,987 A | | 8/1981 | Gibson et al. | |
| 4,405,145 A | | 9/1983 | Bergman et al. | |
| 4,691,792 A | | 9/1987 | Shintani | |
| 5,000,650 A | | 3/1991 | Brewer et al. | |
| 5,001,639 A | | 3/1991 | Breen | |
| 5,152,544 A | | 10/1992 | Dierker, Jr. et al. | |
| 5,234,069 A | | 8/1993 | Krone et al. | |
| 5,572,809 A | | 11/1996 | Steenwyk et al. | |
| 5,825,284 A | * | 10/1998 | Dunwoody et al. | 340/440 |
| RE36,152 E | | 3/1999 | Hosseini et al. | |
| 5,990,787 A | | 11/1999 | Kim | |
| 6,157,889 A | * | 12/2000 | Baker | 701/124 |

* cited by examiner

*Primary Examiner*—Daniel J. Wu
(74) *Attorney, Agent, or Firm*—Liza J. Meyers

(57) ABSTRACT

In the present invention, the distance from a predetermined point to the center of gravity of the load and a first portion of a work machine and the distance from that predetermined point to the center of gravity of the second portion of the work machine are compared, either singly or in a combination, to a predetermined value. Optionally, the articulation angle of the machine and weight and position of the load are combined with a vehicle weight value into a stability value and the stability value is compared to an alarm value. Should an instability condition be detected, an output signal is sent to an output device to alert the operator and/or affect the movement of the machine to prevent instability of the work machine.

10 Claims, 2 Drawing Sheets

APPARATUS AND METHOD FOR A MACHINE STABILITY SYSTEM FOR AN ARTICULATED WORK MACHINE

TECHNICAL FIELD

This invention relates generally to a machine stability system and more specifically to a machine stability system for an articulated work machine that provides an output signal to an output device.

BACKGROUND ART

A variety of articulated machines are utilized for construction and excavation work. Examples of this sort of machine are a wheel loader or an articulated truck. A wheel loader may be used to transport heavy loads from one location to another, often encountering a series of turns and varying grade slopes on the route between two or more locations. If the load being carried is quite heavy, the weight of a front portion of the machine and the load may not be adequately offset by the rear portion of the machine, thus causing an unstable condition. This condition may also occur when the wheel loader is picking up a portion of a load from a pile. In these types and similar instances, the stability of the wheel loader may be less than optimal, sometimes causing the rear wheels of the wheel loader to lift from the ground and providing discomfort to the operator. In extreme conditions the wheel loader can tip over.

U.S. Pat. No. 4,284,987, issued Aug. 18, 1981, to Harry G. Gibson et al. (hereafter referenced as '987) discloses a tip-over warning system for vehicles of the articulated type which utilizes a swing pendulum pivoted in a frame which is mounted on and simulates the stability triangle of the vehicle. The pendulum and frame are connected in an electrical circuit including a current source and an alarm device. When the pendulum touches a side arm of the frame, the circuit is completed, thus energizing the alarm device.

Accordingly, the art has sought a method and apparatus of a machine stability system which: operates reliably; protects the load, machine, and operator from a tip-over; provides operator comfort and acceptability; encourages operator confidence which may lead to more rapid maneuvering and greater productivity; precludes the movement, articulation, or both, of a machine if an instability event occurs; may be used in a timely and efficient manner; and is more economical to manufacture and use.

The present invention is directed to overcoming one or more of the problems as set forth above.

DISCLOSURE OF THE INVENTION

In an embodiment of the present invention, a machine stability system is provided. This system includes a machine, a front sensor system, a rear sensor system, and a controller. The machine is adapted to carry a load. The front sensor system is adapted to produce a front signal indicative of the location of the center of gravity of the load and a portion of the machine relative to a predetermined point. The rear sensor system is adapted to produce a rear signal indicative to the center of gravity of a second portion of the machine relative to the predetermined point. The controller receives the front signal and the rear signal and responsively produces an output signal.

In an embodiment of the present invention, a method of measuring machine stability is provided. This method includes the steps of sensing a front weight and front position and responsively producing a front signal, sensing a rear weight and rear position and responsively producing a rear signal, receiving the front signal and the rear signal, comparing the front signal and the rear signal to predetermined values, and responsively producing an output signal.

In an embodiment of the present invention, a machine stability system is provided. The machine stability system includes a first frame, a second frame, an articulation joint, an articulation sensor, a weight sensor, a position sensor, a controller, and an output device. The articulation joint connects the first frame and the second frame and has an articulation angle. The articulation sensor senses the articulation angle and responsively produces an articulation signal. The weight sensor senses the weight or a load and responsively produces a weight signal. The position sensor senses the position of the load and responsively produces a position signal. The controller receives the articulation angle signal, the weight signal, and the position signal and responsively produces an output signal. The output device receives the output signal.

BRIEF DESCRIPTION OF THE DRAWINGS

For a better understanding of the invention reference may be made to the accompanying drawings in which.

BEST MODE FOR CARRYING OUT THE INVENTION

A preferred embodiment of the present invention provides an apparatus and method of a machine stability system. The following description uses a wheel loader as an example only. The invention can be used with other types of work machines without departing from the spirit and scope of the present invention.

Figure 1:
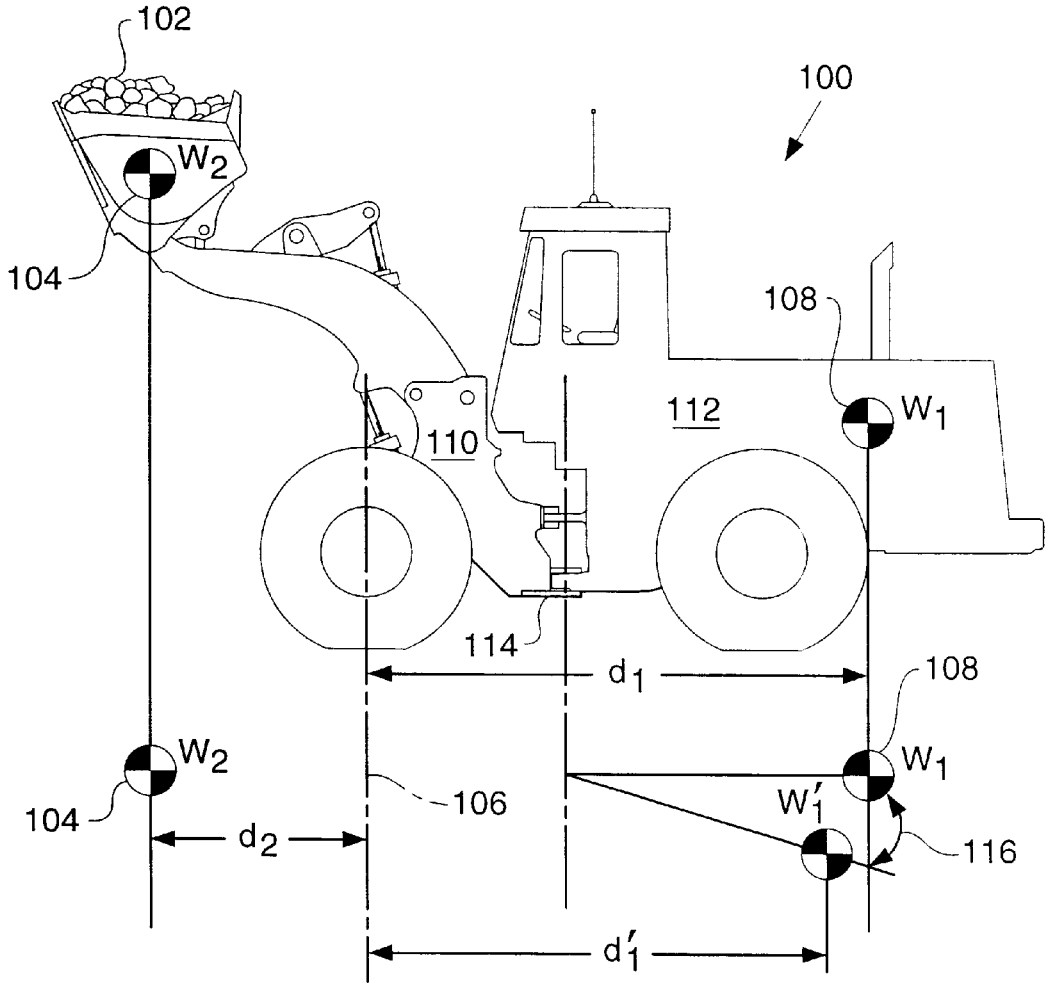
FIG. 1 is a diagrammatic illustration of a preferred embodiment of the present invention.
Figure 2:
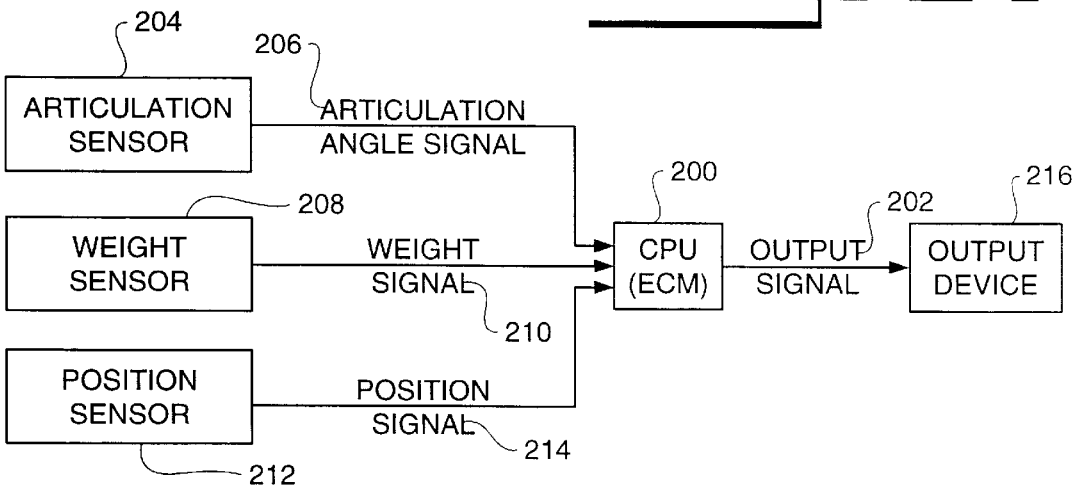
FIG. 2 is a block diagram of a machine stability system of a preferred embodiment of the present invention.

In FIG. 1, a machine 100 which carries a load 102 is disclosed. The machine 100 includes a front sensor system, rear sensor system, and controller 200. The front sensor system produces a front signal indicative of the location of the center of gravity 104 of the combination of the load 102 and a predetermined portion of the machine 100 relative to a predetermined point 106. The rear sensor system produces a signal indicative of the location of the center of gravity 108 of a second predetermined portion of the machine 100 relative to the predetermined point 106. The controller 200 receives the front signal and the rear signal, compares the front signal and the rear signal to predetermined values, and responsively produces an output signal 202.

In an embodiment of the present invention, the controller 200 calculates a combined signal based on the front signal and rear signal. This combined signal indicates the position of the center of gravity of the combination of the load 102 and machine 100 relative to a predetermined point 106. The controller 200 compares the combined signal to at least one predetermined value and responsively produces an output signal.

An embodiment of the present invention includes a machine 100 having a first frame 110, a second frame 112, an articulation joint 114, an articulation sensor 204, a weight sensor 208, a position sensor 212, and a controller 200. The articulation joint 114 has an articulation angle 116 which indicates the positional relationship between the first frame 110 and the second frame 112. The articulation sensor 204 senses the articulation angle 116 and responsively produces an articulation angle signal 206. The weight sensor 208 senses the weight of the load 102 carried by one of the first frame 110 and the second frame 112 and responsively produces a weight signal 210. The position sensor 212 senses the position of a load 102 carried by one of the first frame 110 and the second frame 112 and responsively produces a position signal 214. The controller 200 receives the articulation angle signal 206, the weight signal 210, and the position signal 214 and responsively provides an output signal 202. The output signal 202 is then sent by the controller 200 to an output device 216. Preferably, the output device is at least one of: a visible device, such as a light or a display; an audible device, such as a bell, whistle, or horn; a tactile device; or a machine control devise, such as a steering or braking system.

The controller 200 is adapted to receive the weight signal 210, the position signal 214, and the articulation angle signal 206 and provide an output signal 202 in response to the weight signal 210, the position signal 214, and the articulation signal 206. Preferably, the controller 200 is one of many readily available computers capable of processing numerous instructions. It should be appreciated that the controller 200 may include multiple processing units configured in a distributed structure environment and forming a system.

The predetermined values used by the controller 200 may be taken from a table, a formula, an algorithm, or any combination thereof. The controller is commonly known as a central processing unit (CPU) or an electronic control module (ECM). In a preferred embodiment, the controller is a microprocessor. However, other suitable controllers are known in the art, any one of which could be readily and easily used in connection with an embodiment of the present invention. A specific program code can be readily and easily written from the flow chart, shown in FIG. 3, in the specific assembly language or microcode for the selected microprocessor.

Figure 3:
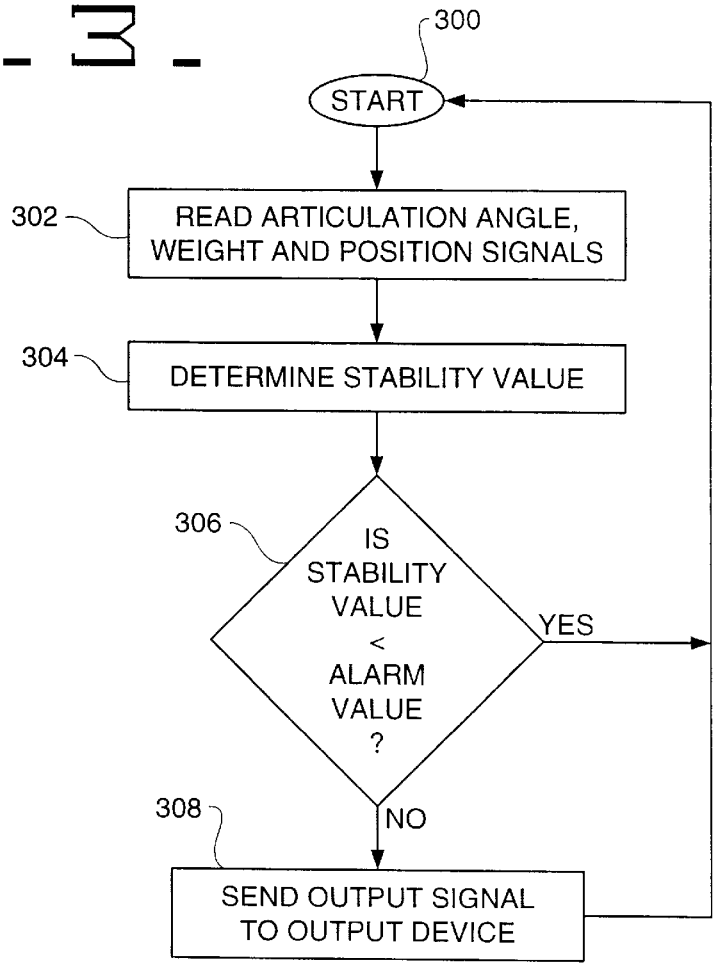
FIG. 3 is a flow chart diagram of a preferred embodiment of the present invention.

FIG. 3 illustrates a flowchart of the logic of the present invention. The logic starts at the start block 300. The controller 200 then proceeds to the read block 302 in which it reads the articulation angle signal 206, the weight signal 210, and the position signal 214. Next, the controller 200 determines the stability value at the stability block 304. In the comparison block 306, the controller 200 compares the stability value to an alarm value. If the stability value is less than the alarm value, the controller 200 returns to the start block 300. If the stability value is greater than or equal to the alarm value, the controller 200 sends an output signal 202 to the output device or devices 216 in block 308 and then returns to the start block 300.

The logic of FIG. 3 is performed frequently enough to provide the desired resolution and time responsiveness for determining and alerting at least one of an operator, a service organization, a customer, and an owner of the machine of an instability event, and preferably performed frequently enough to warn the operator of the instability event in time that he or she may take action to prevent a tip-over.

While aspects of the present invention have been particularly shown and described with reference to the preferred embodiments above, it will be understood by those skilled in the art that various additional embodiments may be contemplated without departing from the spirit and scope of the present invention. For example, the weight of the load 102 could be sensed in a different manner or any of the signals or values in the present invention could be determined in a different manner than those described, such as mathematically or by requesting operator inputs. However, a device or method incorporating such an embodiment should be understood to fall within the scope of the present invention as determined based upon the claims below and any equivalence thereof.

INDUSTRIAL APPLICABILITY

Many articulated machines, such as wheel loaders, carry very heavy loads in the course of their work in the field. These loads may, in fact, be heavy enough to cause the machine to be unstable, especially when the machine is turning. An articulated machine, such as a wheel loader, is used to lift and carry loads. When a load is lifted on the front of the machine, there must be enough weight on the rear of the machine to keep the rear wheels on the ground. In many applications, such as in some forestry industry applications, the loads lifted are such that the weight of the load is almost as much as the rear weight holding the machine stable. As the machine starts to travel, the rear end is on the ground. If the operator tries to make a sharp turn, the distance to the weight on the rear of the machine is shortened and the machine may become unstable, causing the rear end of the machine to lift off the ground and resulting in a travelling tip-over. A stationary tip-over can also occur when the machine is picking up a load due to very heavy weight on the front of the machine. The present invention is directed toward overcoming tip-overs of both the travelling and stationary types, but the present invention will be discussed in the context of a travelling tip-over. The controller 200 performs similar operations in the case of a stationary tip-over.

In the present invention, the distance from a certain predetermined point to the center of the gravity of the combined weight of the load in the first portion of the machine is calculated. In a like manner, the distance from that same predetermined point to the center of gravity of a second portion of the machine is calculated. The two distances are then compared to each other or to a predetermined value or range of values, or a combined signal can be calculated from the two centers of gravity, to provide an output signal. If this output signal indicates that an instability condition is present, a warning is given to an operator using a visible device, an audible device, or a tactile device. The output signal can also or instead go to a machine control device, such as a steering or braking system, so that the operator is not allowed to order a machine action which will cause continued or further instability of the machine.

Alternatively, a controller receives signals corresponding to the articulation angle of the machine, and the weight and position of the load, and determines a stability value from those inputs along with a known vehicle weight value. The stability value is then compared to an alarm value. If the stability value is above a predetermined alarm value, taken from a table, a formula, an algorithm, or combination thereof, or outside a range of such alarm values, an output signal is then sent to an output device.

In operation of the present invention, the operator picks up a load with the machine and begins to travel to another location. This traveling of the machine is commonly called "roading". The controller monitors the machine and load properties, as described above, while the machine is roading. If the controller detects that the machine is approaching a position in which a tip-over can occur, an alarm or signal alerts the operator of this instability event. The operator is then responsible for controlling the machine to bring it to a more stable position. Optionally, the steering or braking system of the machine is controlled, with or without the alarm or signal alerting the operator, to prevent any action being taken which does not result in a more stable machine position.

The apparatus and method of certain embodiments of the present invention, when compared with other methods and apparatus, may have the advantages of: reliable operation; protection of the load, machine, and operator from tip-over or instability conditions; providing operator comfort and acceptability; providing operator confidence leading to more rapid maneuvering and greater efficiency; precluding movement, articulation, or both of the machine when an instability condition is detected; and more economical manufacture and use. Such advantages are particularly worthy of incorporating into the design, manufacture, and operation of wheel loaders. In addition, the present invention may provide other advantages that have not been discovered yet.

It should be understood that while a preferred embodiment is described in connection with a wheel loader, the present invention is readily adaptable to provide similar functions for other work machines. Other aspects, objects, and advantages of the present invention can be obtained from a study of the drawings, the disclosure, and the appended claims.

What is claimed is:

1. A machine stability system, comprising:

a machine adapted to carry a load;

a front sensor system adapted to produce a front signal indicative of the location of the center of gravity of the combination of the load and a predetermined portion of the machine relative to a predetermined point;

a rear sensor system adapted to produce a rear signal indicative of the location of the center of gravity of a second predetermined portion of the machine relative to the predetermined point; and a controller adapted to receive the front signal and the rear signal, compare the front signal and the rear signal to predetermined values from at least one of a table, a formula, an algorithm, and a combination thereof, and responsively produce an output signal.

2. The machine stability system of claim 1, wherein the controller calculates a combined signal based on the front signal and the rear signal which indicates the position of the center of gravity of the combination of the load and machine relative to a predetermined point, compares the combined signal to at least one predetermined value, and responsively produces an output signal.

3. A method of measuring machine stability, comprising the steps of:

sensing a front weight and front position, determining the center of gravity, relative to a predetermined point, of a load combined with a predetermined portion of a machine, and responsively producing a front signal;

sensing a rear weight and rear position, determining the center of gravity, relative to the predetermined point, of a second predetermined portion of the machine, and responsively producing a rear signal;

receiving the front signal and the rear signal;

comparing the front signal and the rear signal to predetermined values from at least one of a table, a formula, an algorithm, and a combination thereof; and responsively producing an output signal.

4. The method of claim 3, further comprising the steps of:

calculating a combined signal, indicative of the position of the center of gravity of the load and the machine relative to a predetermined point, based on the front signal and the rear signal; and comparing the combined signal to a predetermined value from at least one of a table, a formula, an algorithm, and a combination thereof.

5. The method of claim 3, including the steps of:

reading an articulation angle signal;

reading a weight signal;

reading a position signal;

determining a stability value from the articulation angle, weight, and position signals;

comparing the stability value to a predetermined alarm value; and responsively sending an output signal to an output device.

6. A machine stability system, comprising:

a first frame;

a second frame;

an articulation joint connecting the first frame and the second frame and having an articulation angle indicating the positional relationship between the first frame and the second frame;

an articulation sensor adapted to sense the articulation angle and responsively produce an articulation angle signal;

a weight sensor adapted to sense the weight of a load carried by one of the first frame and the second frame and responsively produce a weight signal;

a position sensor adapted to sense the position of a load carried by the one of the first frame and the second frame and responsively produce a position signal;

a controller adapted to receive the articulation angle signal, the weight signal, and the position signal and responsively provide an output signal; and an output device for receiving the output signal.

7. The machine stability system of claim 6, wherein the output device is at least one of a visible device, an audible device, a tactile device, and a machine control device.

8. The machine stability system of claim 7, wherein the controller is further adapted to determine a stability value, based on the weight signal, the position signal, the articulation signal, and a machine weight value, from at least one of a table, a formula, an algorithm, and a combination thereof.

9. The machine stability system of claim 8, wherein the controller compares the stability value to at least one of a predetermined alarm value and a predetermined range of alarm values, each alarm value provided by at least one of a table, a formula, an algorithm, and a combination thereof, and responsively produces the output signal.

10. The machine stability system of claim 9, wherein the controller determines the output device responsive to the comparison of the stability value and the alarm value and responsively sends the output signal to the chosen output device.

* * * * *